US006205758B1

(12) United States Patent
Weideman et al.

(10) Patent No.: US 6,205,758 B1
(45) Date of Patent: Mar. 27, 2001

(54) PREPARING TEXTILE FIBRES FOR TESTING

(75) Inventors: Etienne Weideman, Somerset West; Jaromir Cizek, Port Elizabeth, both of (ZA)

(73) Assignee: Technology Finance Corporation, Sandton (ZA)

( * ) Notice: Subject to any disclaimer, the term of this patent is extended or adjusted under 35 U.S.C. 154(b) by 0 days.

(21) Appl. No.: 09/296,838

(22) Filed: Apr. 22, 1999

(30) Foreign Application Priority Data

Apr. 24, 1998 (ZA) ..... 98/3492

(51) Int. Cl.[7] ..... D01H 5/00
(52) U.S. Cl. ..... 57/1 UN; 57/2.3; 57/315
(58) Field of Search ..... 57/1 UN, 1 R, 57/2.3, 315; 73/160, 828, 830, 831; 19/65 A

(56) References Cited

U.S. PATENT DOCUMENTS 1,891,435 * 12/1932 Meyer ..... 57/1 UN
3,866,403 * 2/1975 Zimmermann, Jr. ..... 57/1 R

FOREIGN PATENT DOCUMENTS 45-21254 * 7/1970 (JP) ..... 57/1 UN
53-38339 * 10/1978 (JP) ..... 57/1 R

* cited by examiner

*Primary Examiner*—John J. Calvert
*Assistant Examiner*—Gary L. Welch
(74) *Attorney, Agent, or Firm*—Ladas and Parry

(57) ABSTRACT

Yarn is unwound from a reel by means of unwinding rollers. Simultaneously the yarn is untwisted partially to free constituent fibers by means of a rotating arm guiding the yarn through an eye. Nip rollers prevent slack in the untwisted yarn. Drafting rollers draft the untwisted yarn to break bonding among the fibers. A pair of endless belts moving in opposing relation hold the drafted fibers together in a bundle. The fibers are sucked from the bundle via a conduit into a foraminous container from which the fibers can individually be reclaimed for testing.

40 Claims, 4 Drawing Sheets

PREPARING TEXTILE FIBRES FOR TESTING

THIS INVENTION relates broadly to the testing of textile fibres, more specifically to a method of and an apparatus for preparing textile fibres for testing.

When a length of textile yarn is formed, its constituent textile fibres are twisted or twined together to cause the fibres frictionally to grip together to form the length of yarn.

In accordance with a first aspect of this invention, broadly, there is provided a method of obtaining fibres from a yarn for testing, including mechanically untwisting the yarn, mechanically separating fibres which have formed the yarn, and gathering said fibres.

It is sometimes required to examine or test the constituent fibres of a length of yarn after the fibres have been twined into the length of yarn or even after a textile article has been produced of the yarn. Such tests or examinations are sometimes directed at determining fibre properties such as length, length distribution, strength, elongation, stiffness, bulk, diameter, fibre linear density, micronaire or fibre fineness in the case of cotton fibres, maturity in the case of cotton fibres, total impurities or contamination in the fibres and the like. To achieve this, it is required to dismantle the yarn into its constituent fibres since these tests or examinations are best or can sometimes only be conducted on the fibres when in a dismantled condition. Such tests and examinations are normally conducted on staple fibres such as cotton, polyester, viscose, nylon, acrylic, modacrylic, polypropylene, wool and other synthetic or natural fibres, or blends of such fibres.

This invention thus provides a method whereby a length of yarn can be dismantled into its constituent fibres in a mechanical fashion, i.e. a non-manual fashion, thus making it feasible to obtain fibres for testing on a commercial basis or scale.

The method may include the prior step of establishing the lay, S or Z, of the yarn and determining the appropriate direction for untwisting the yarn. Untwisting the yarn may be to a degree of 100%+30%. Thus, for example, if the mean twist of the yarn is, say 900 turns per metre, the degree of untwisting may be between about 600 turns per metre (100%−30% approximately) and about 1200 turns per metre (100%+30% approximately). It is to be appreciated that untwisting is to be to a degree to relieve the frictional gripping amongst fibres sufficiently to allow the fibres to be separated by drafting. The Applicant envisages that the optimum degree of untwisting may vary from one kind of fibre and from one kind of yarn construction to another and that routine experimentation may be required to establish an optimum degree or range of untwisting for particular circumstances.

For purposes of this specification, the term "untwisting" is to be understood functionally, i.e. untwisting to a degree which is appropriate for the intended purpose.

The method may preferably include drafting said untwisted yarn to break remaining bonding or adhesion between the fibres.

The method may include unwinding the yarn from a reel, untwisting the yarn then being simultaneous with unwinding of the yarn from the reel. Untwisting the yarn may be by rotating an arm about the reel and guiding the yarn through an eye at an end of the arm. Instead, untwisting the yarn may be by rotating the reel about a polar axis of the reel while unwinding is effected by spinning the reel about an unwinding axis of the reel. The polar axis may be normal to the unwinding axis.

A rate of untwisting the yarn may be responsive to a rate of unwinding the yarn such that the rate of untwisting relative to the rate of unwinding is appropriate for the desired degree of untwisting.

When the method includes drafting the untwisted yarn to break remaining bonding or adhesion between the fibres, drafting may at least partially be between two pairs of nip rollers operating in series, a downstream pair of the nip rollers having a peripheral speed faster than a peripheral speed of an upstream pair of the nip rollers.

The degree of drafting may vary from one application to another. Generally, the Applicant believes that the higher the degree of drafting the better, but naturally there are physical and practical limitations to the degree of drafting which can be obtained. As a rough guideline, drafting may be of the order of about 200%. Routine experimentation may be required to establish an appropriate degree of drafting for particular circumstances.

For purposes of this specification, the term "drafting" must be understood functionally, i.e. drafting to a sufficient degree to break the adhesion between the fibres.

Drafting may include guiding the untwisted yarn between surfaces moving in the direction of drafting and pressing the fibres together to form a bundle of loose or drafted fibres. The surfaces may be provided by opposing surfaces of a pair of opposing, rotating, endless belts.

Separating and gathering the fibres may be by transporting them by means of air movement into a foraminous container. Said air movement may advantageously be obtained by suction.

Separating and gathering may, instead or in addition, include raking the fibres while part of the untwisted yarn, or while part of the bundle of loose or drafted fibres.

The method may include loosely winding the fibres around a drum or wheel provided for this purpose to gather the fibres. The drum or wheel may be hollow, a periphery of the drum or wheel being foraminous, the method including applying suction to suck the fibres onto the foraminous periphery. The method may then include removing the fibres loosely wound around the drum or wheel in the form of a sliver having a length commensurate with the periphery of the drum or wheel.

By way of development, the method may include subjecting the fibres to steam prior to removal.

In accordance with a second aspect of this invention, there is provided a yarn dismantling apparatus including mechanical untwisting means operable to untwist yarn formed by fibres; and separating and gathering means for separating and gathering the fibres.

The apparatus may include a spindle for rotatably supporting a reel holding the yarn to be dismantled about an unwinding axis.

The mechanical untwisting means may include an arm having an eye at an end thereof, the arm being rotatable in a selected direction to cause the eye to orbit the reel in the selected direction.

An inner end of the arm may be mounted on a bush or bearing rotatable about the spindle or a journal coaxial with the spindle, the apparatus including drive means for rotating the arm in said selected direction and at a selected speed by transmitting drive via the bush or bearing to the arm.

Instead, the untwisting means may include means for rotating the reel about a polar axis thereof. The polar axis may be normal to the unwinding axis.

The apparatus may include unwinding means for unwinding the yarn at a selected rate from the reel, the unwinding means including a pair of unwinding nip rollers downstream of the spindle, the unwinding nip rollers being rotatable such that a tangential speed thereof corresponds with the selected rate of unwinding.

The apparatus may include a pair of intermediate nip rollers downstream of the unwinding nip rollers. The intermediate nip rollers may be rotated such that a tangential speed thereof is only very slightly faster than that of the unwinding rollers to prevent slack in the length of untwisted yarn.

Preferably, the apparatus may include drafting means for drafting said untwisted yarn to break remaining bonding among respective fibres, the drafting means including a pair of driven drafting nip rollers downstream of the unwinding nip rollers, and downstream of any intermediate nip rollers. A spacing between the drafting nip rollers and nip rollers upstream thereof may advantageously be at least more than the longest fibre length in the yarn being dismantled. The apparatus may include drive means drivingly connected to the drafting nip rollers to drive them at a tangential speed faster than that of the unwinding rollers, to cause corresponding drafting to an appropriate degree to break any remaining bonding among the fibres.

The drafting means may advantageously further include opposing surfaces moving with the fibres being drafted to hold the fibres together in a bundle of loose or drafted fibres. The opposing surfaces may be provided by opposing surfaces of opposing rotating endless belts. The endless belts may conveniently be rotated about the nip rollers upstream of the drafting nip rollers.

In at least one pair of the pairs of nip rollers, and advantageously in each pair of the pairs of nip rollers, one roller may be positively driven, the other roller being frictionally driven by said one roller, and said other roller being resiliently biassed toward said one, driven, roller. The bias may be adjustable.

The separation means may be in the form of suction means for sucking the fibres from the untwisted yarn or the bundle of loose or drafted fibres so as to separate the fibres.

Instead, or in addition, the separation means may include a rake member for raking the fibres from the untwisted yarn or the bundle of loose or drafted fibres so as to separate the fibres.

The apparatus may include a foraminous collection VP container and guide means for guiding the separated fibres to the foraminous collection container. The guide means may include a conduit leading to the foraminous collection container.

By way of development, the apparatus may include a wheel or drum aligned with a path of the untwisted yarn or the bundle of loose or drafted fibres where the fibres are desired to be collected, and rotating means for rotating the drum to cause the untwisted yarn or the bundle of loose or drafted fibres to be loosely wound over the drum. The apparatus may then include suction means to suck the fibres onto a periphery of the drum, the drum being hollow and its periphery being foraminous to enable suction to be applied.

By way of further development, the apparatus may include steam means for steaming the untwisted yarn or the bundle of loose or drafted fibres. The steam means may include a nozzle directed onto the untwisted yarn or the bundle of loose or drafted fibres, which nozzle is connected to a source of steam.

The invention is now described by way of examples with reference to the accompanying diagrammatic drawings. In the drawings FIG. 1 shows, schematically, in side view, one embodiment of yarn dismantling apparatus in accordance with the invention;

Figure 1:
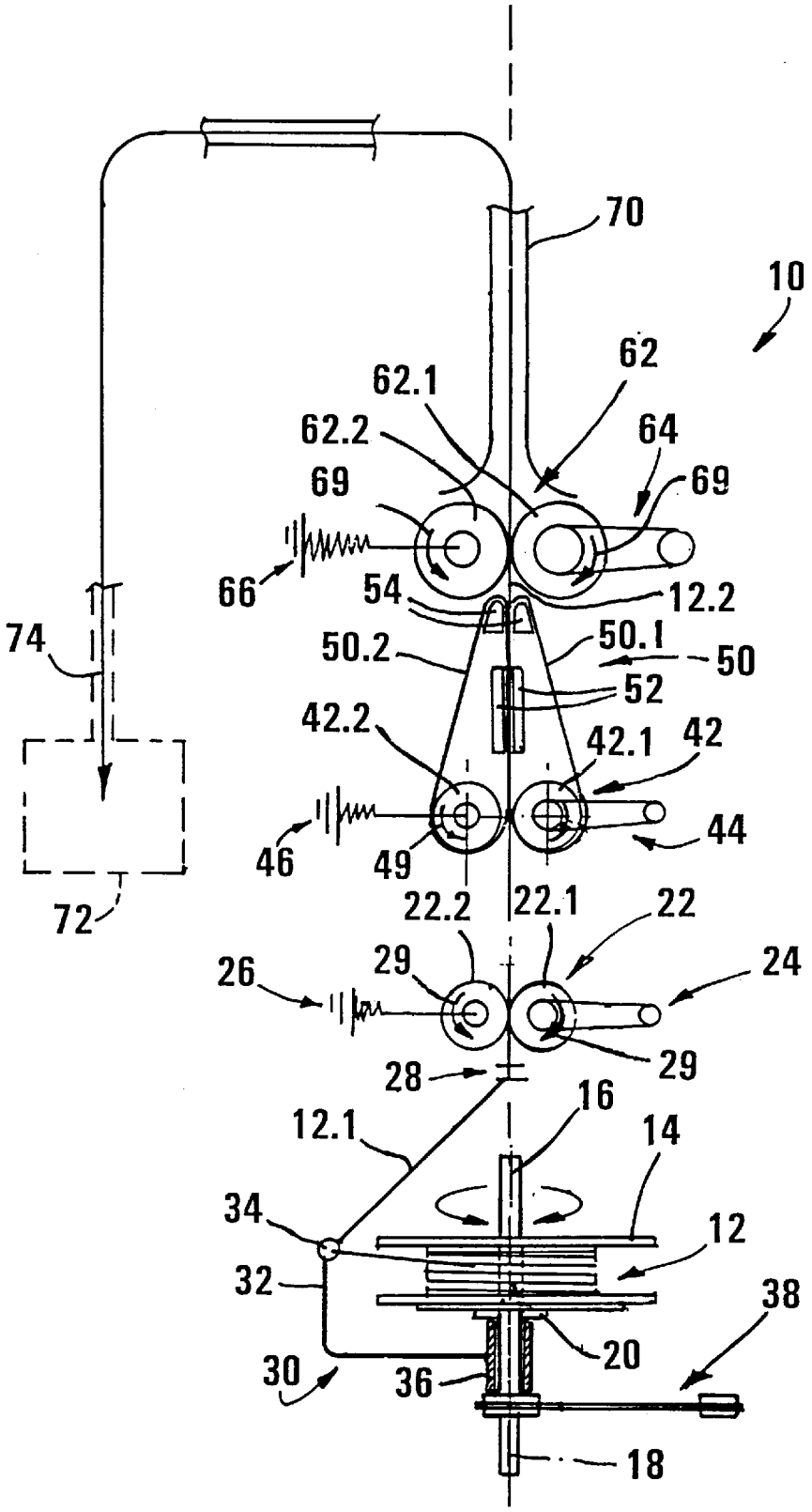

With reference to FIG. 1, a yarn dismantling apparatus in accordance with the invention is generally indicated by reference numeral 10. By means of the apparatus 10, yarn 12 wound on a reel 14 is dismantled in accordance with the invention into its constituent fibres.

In the embodiment of FIG. 1, the reel 14 is rotatably supported on a spindle 16 defining a rotation axis 18. The reel 14 rests on a shoulder 20 which is narrow so as to limit friction between a flange of the reel 14 and the shoulder. However, the arrangement is such that the reel 14 does encounter some resistance to rotation so as to keep the yarn taut when being unwound as will be described hereinafter.

Unwinding of the yarn 12 from the reel 14 is effected by means of a pair of unwinding nip rollers 22. The nip rollers 22.1 and 22.2 oppose each other to be counter-rotatable about parallel axes. The yarn is threaded through a guide 28 aligned with an interface of the nip rollers 22.1 and 22.2. It is schematically shown at 24 that the nip roller 22.1 is driven in a direction 29. The nip roller 22.2 is conveniently driven in a corresponding, counter-rotating direction 29 by its frictional engagement with the nip roller 22.1. It is also schematically shown at 26 that the nip roller 22.2 is resiliently biassed toward the nip roller 22.1 to effect a predetermined and desired amount of pressure therebetween. The resilient bias can conveniently be adjusted to adjust the pressure.

In accordance with the invention, the yarn 12 is untwisted (in accordance with functional requirements explained above) during unwinding from the reel 14. This is effected, in the embodiment shown in FIG. 1, by means of untwisting means 30 comprising an arm 32 having an eye 34 at a free end thereof. An opposed end of the arm 32 is fixed to a bush 36 which is rotatable about the axis 18. The arm 32 is rotated by means of driving means schematically shown at 38.

It is to be appreciated that the degree of untwisting is predetermined as explained above.

Untwisting is effected by rotating the arm 32 and thus also the yarn 12 which is received via the eye 34 upstream of the guide 28, around the axis 18 while unwinding takes place. For example, assume that a yarn having a twist rating of 800 twists per meter length is to be dismantled and that the degree of untwisting is predetermined at 90%. Then, for every meter length of yarn which is unwound from the reel 14, the arm 32 will be rotated 720 times around the reel. Naturally, the lay of the yarn i.e. S or Z, is determined and then the arm 32 is rotated in a direction which is appropriate for untwisting the yarn.

Thus, downstream of the untwisting means 30, the yarn is actually in the form of untwisted yarn as indicated by reference numeral 12.1. The untwisted yarn can be collected downstream of the rollers 22 to allow testing thereof if required.

In some yarns, the rate of twist and thick/thin portions of the yarn vary considerably. Therefore, the distance over which untwisting action is applied should be as short as practically possible in order to distribute the untwisting more regularly along the yarn.

Downstream of the unwinding nip rollers 22, in this embodiment, there is provided an intermediate pair of nip rollers generally indicated by reference numeral 42. The nip rollers 42 are similar to the unwinding nip rollers 22, comprising a first, driven nip roller 42.1 which is driven as schematically shown at 44, a second nip roller 42.2 which is frictionally rotated by means of the nip roller 42.1 in a counter-rotating direction 49 and which is resiliently biassed as indicated by reference numeral 46 to cause a predetermined amount of pressure between the nip rollers.

By way of development, a pair of endless belts generally indicated by reference numeral 50 is provided in conjunction with the intermediate nip rollers 42. Each of the endless belts 50.1 and 50.2 is wound around its nip roller 42.1 or 42.2 and then extends in a downstream direction where the belts are guided by end shoes 54 defining extremities of the loops of the endless belts. Intermediate the intermediate nip rollers 42 and the end shoes 54, there are provided two platen 52 guiding the belts to move closely against each other and even, if desired, to induce some pressure between the belt surfaces.

The function of the endless belts 50 will become apparent later.

Especially in some applications, it may be desirable that the yarn 12 is untwisted only partially or is over untwisted, i.e. untwisted to more than 100% to ensure that there is a small, but nevertheless significant, amount of bonding remaining between the fibres to keep the untwisted yarn intact. For purposes of this invention, for economy of writing, the term "untwisted yarn" will denote partially untwisted or over untwisted yarn. Thus, if desired, the intermediate nip rollers 42 may be rotated at a tangential speed only very slightly faster than the tangential speed of the unwinding nip rollers 22, merely to keep the untwisted yarn 12.1 taut.

Drafting means in the form of drafting nip rollers 62 is provided to draft the fibres in the untwisted yarn 12.1 relative to each other thus to break the resilient bonding and also to undo any residual twisting which there may or may not be. Thus, one drafting nip roller 62.1 is driven as schematically indicated by reference numeral 64 at a tangential speed appropriately faster than the intermediate nip rollers 42 as is explained above. The other drafting nip roller 62.2 is counter-rotated by frictional interaction across the interface between the nip rollers 62, the nip roller 62.2 being resiliently biassed toward the nip roller 62.1 generally as indicated by reference numeral 66. The direction of counter-rotation is indicated by arrow 69.

Thus, the drafting means accelerates the fibres, drafting them out of cohesion with one another. It is to be appreciated that the drafting nip rollers 62 are spaced downstream of the intermediate nip rollers 42 by an amount at least the length of the longest fibre in the yarn so as to prevent breakage of fibres. Thus, the untwisted yarn 12.1 is drafted into a bundle of loose or drafted fibres indicated at 12.2 by means of the drafting means 62. The bundle 12.2 of loose or drafted fibres is held together by means of the endless belts 50. The bundle 12.2 of loose or drafted fibres can be collected downstream of the rollers 62 to allow testing thereof.

Downstream of the drafting means 62, there is provided a throat and conduit 70 through which air is moved at high speed, conveniently by means of sucking, to suck the individual, dismantled fibres via the conduit 70 as indicated by reference numeral 74 into a foraminous container 72. The fibres can be collected from the foraminous container 72 to allow testing thereof.

Figure 2:
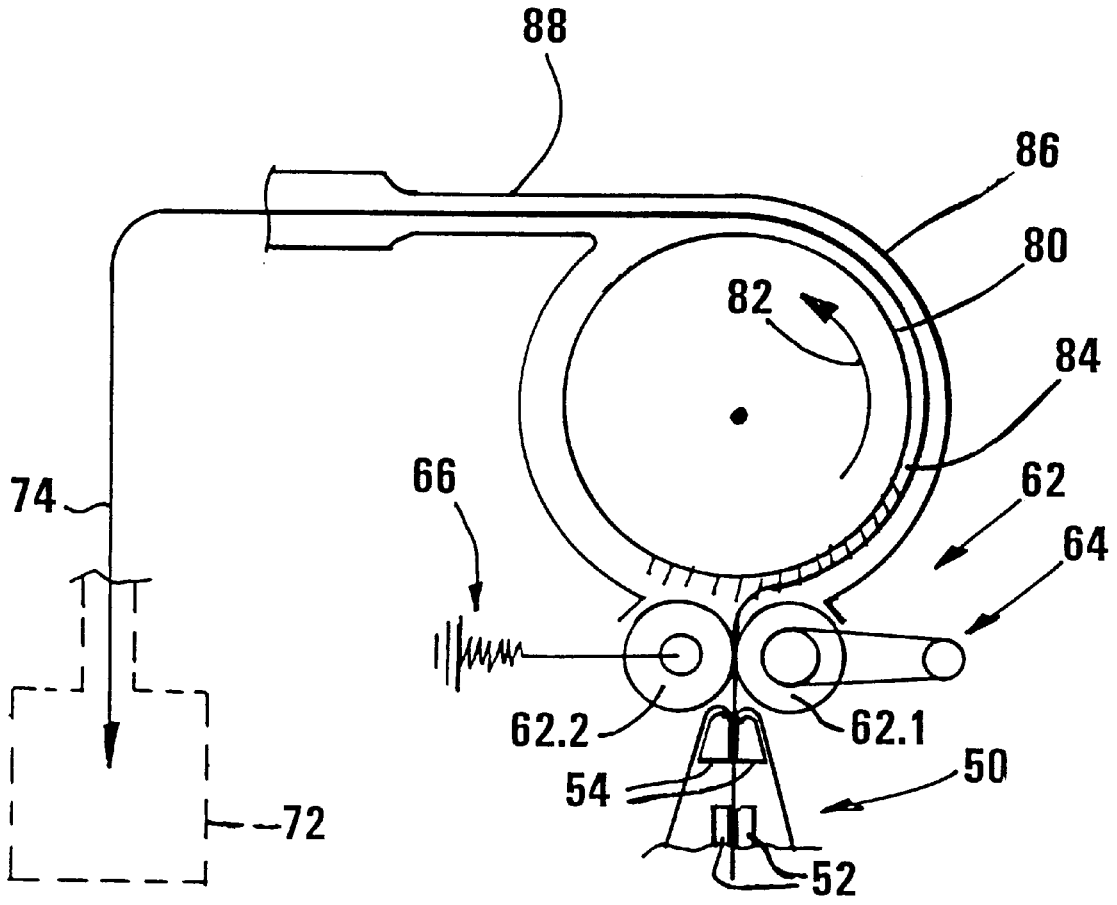
FIG. 2 shows, in side view, fragmentarily, a variation of fibre separating means of the yarn dismantling apparatus of FIG. 1.

With reference to FIG. 2, in a variant of the embodiment of FIG. 1, a wheel 80, having generally outwardly directed, peripheral rake members or prongs 84, is rotated as indicated at 82. The prongs 84 rake the fibres of the bundle 12.2 of loose or drafted fibres further to separate them from one another. A shield 86 defines a part annular channel about the periphery of the wheel, via which annular channel air is moved by suction to transport the fibres via tangential channel 88 extending form the annular channel to the foraminous container 72.

Figure 3:
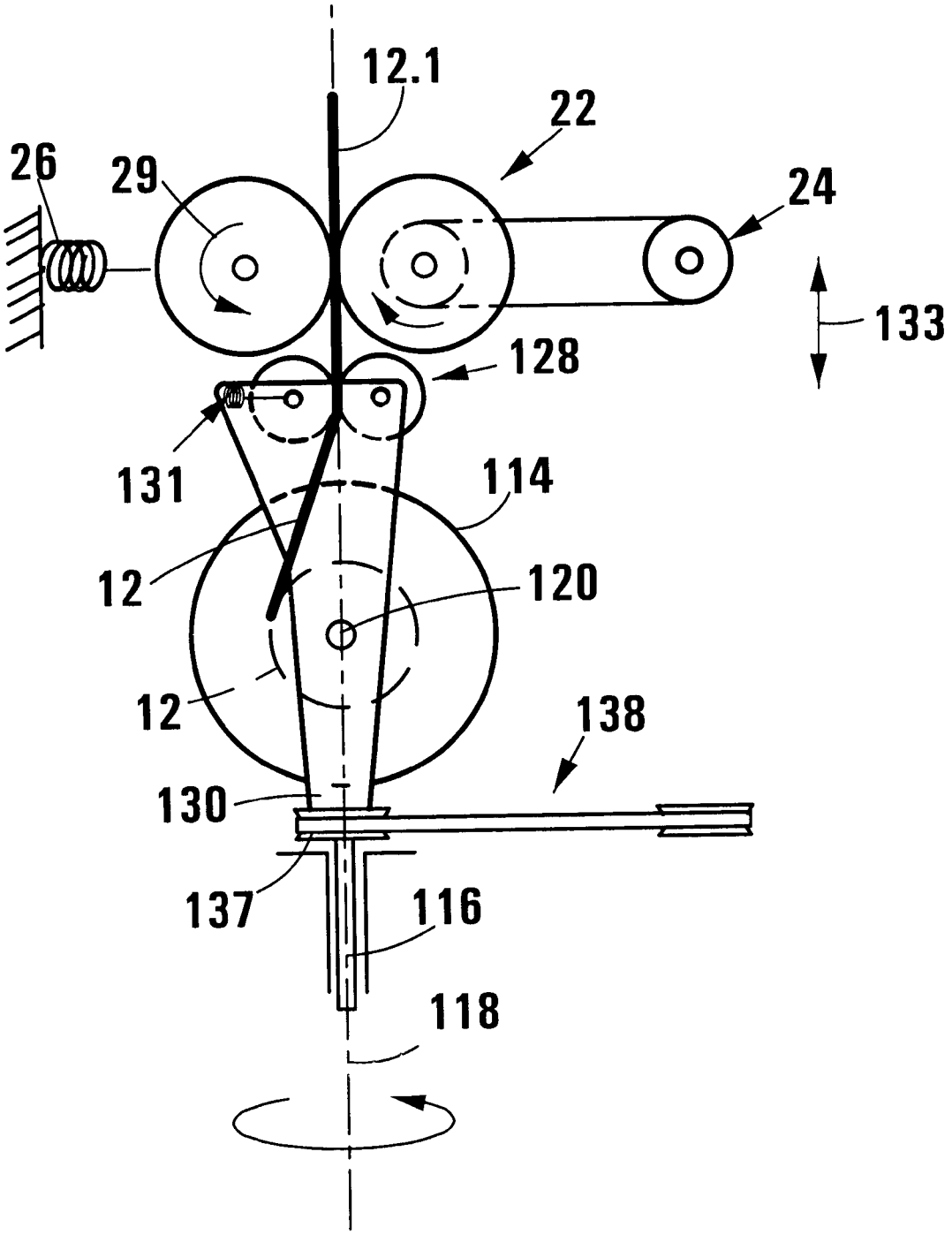
FIG. 3 shows, in side view, fragmentarily, a variation of yarn untwisting means of the yarn dismantling apparatus of FIG. 1.

With reference to FIG. 3 of the drawings, another embodiment of untwisting means in accordance with the invention is shown. Only the untwisting means is shown. The yarn is pulled from the reel by means of unwinding nip rollers which can be similar to or identical to the rollers 22 of FIG. 1.

For ease of reference, generally, like reference numerals are used to denote like features or components. Thus, differences to the untwisting means of FIG. 1 will be emphasized and the whole of the untwisting means will not be described in detail.

The reel 114 is supported for rotation about an unwinding axis thereof about an unwinding spindle 120 which, in this embodiment, is transverse to the general direction of movement of the yarn 12, in contrast to the orientation of the reel in FIG. 1. The spindle 120 is supported between a pair of upwardly directed, generally parallel, cheekplates (of which only one is shown at 130 in FIG. 3) which cheekplates are fixed to a driven pulley 137 of the untwisting drive means 138. Thus, the pulley 137, and with it the cheekplates 130 and with them the unwinding spindle 120 and the whole of the reel 114, are rotatable about an upwardly directed spindle 116 about an untwisting axis 118. Thus, unwinding of the yarn 12 from the reel 114 takes place about an unwinding axis and untwisting of the yarn takes place about an untwisting axis 118 corresponding to a polar axis of the reel 114 which polar axis is normal to the spinning axis.

Also supported between the cheekplates 130, is a pair of guide rollers generally indicated by reference numeral 128. As was described for other pairs of rollers above, one of the guide rollers 128 is rotatable about a spindle supported in a fixed position between the cheekplates 130, and the opposing other of the guide rollers 128 is biassed by means of a resilient bias means such as a spring 131 toward the located guide roller to ensure a desired amount of pressure on the yarn 12 between the guide rollers 128. The guide rollers 128 align the yarn with the unwinding rollers 22, which can be visualized as identical with the unwinding rollers of the embodiment of FIG. 1.

Untwisting takes place between the guide rollers 128 and the unwinding nip rollers 22 i.e. over a very short distance indicated by reference numeral 133.

As was described above with reference to FIG. 1, the drive means 138 can be adjusted to cause untwisting in either direction, and to a desired, predetermined degree. Thus, the direction of drive of the drive means 138 and the speed at which it operates, can be adjusted.

It is further to be appreciated that rotation of the assembly about the untwisting axis 118 takes place at relatively high speed. Thus, care will be taken that the assembly is balanced. In this regard, it is to be appreciated that biassing as indicated at 131 of the floating guide roller is compact such that the cheekplates 130 and the biassing means will not unduly detrimentally affect balancing of the assembly.

Figure 5:
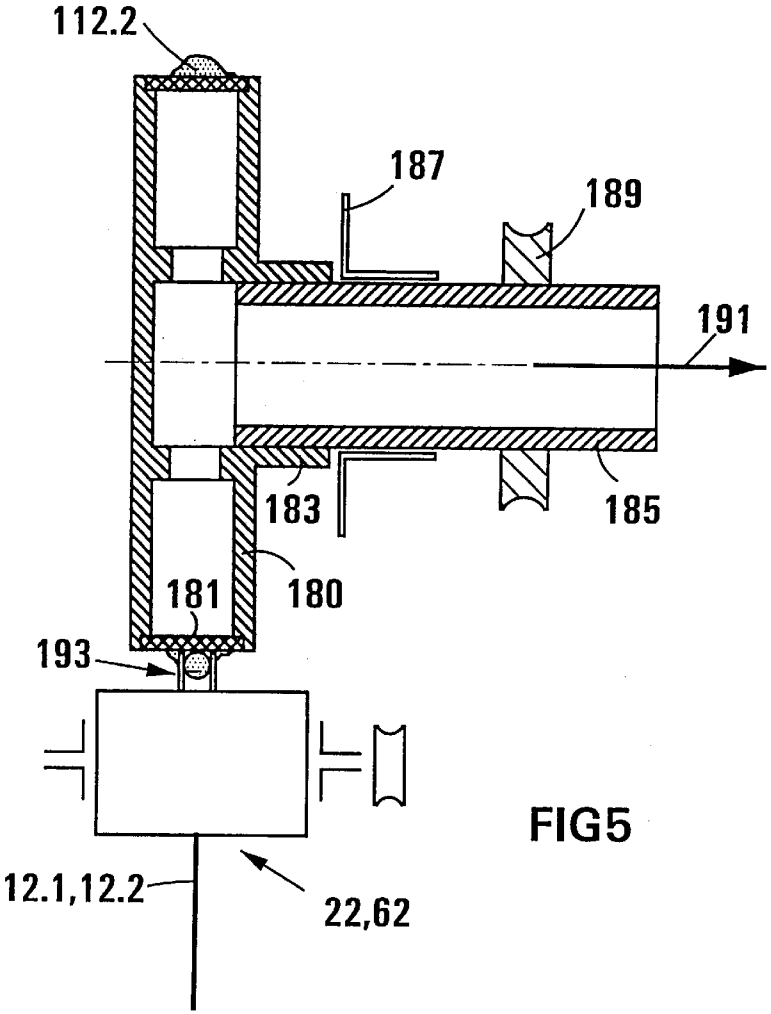
FIGS. 4 and 5 show, respectively in axial view and in end view, another embodiment of fibre gathering means.
Figure 4:
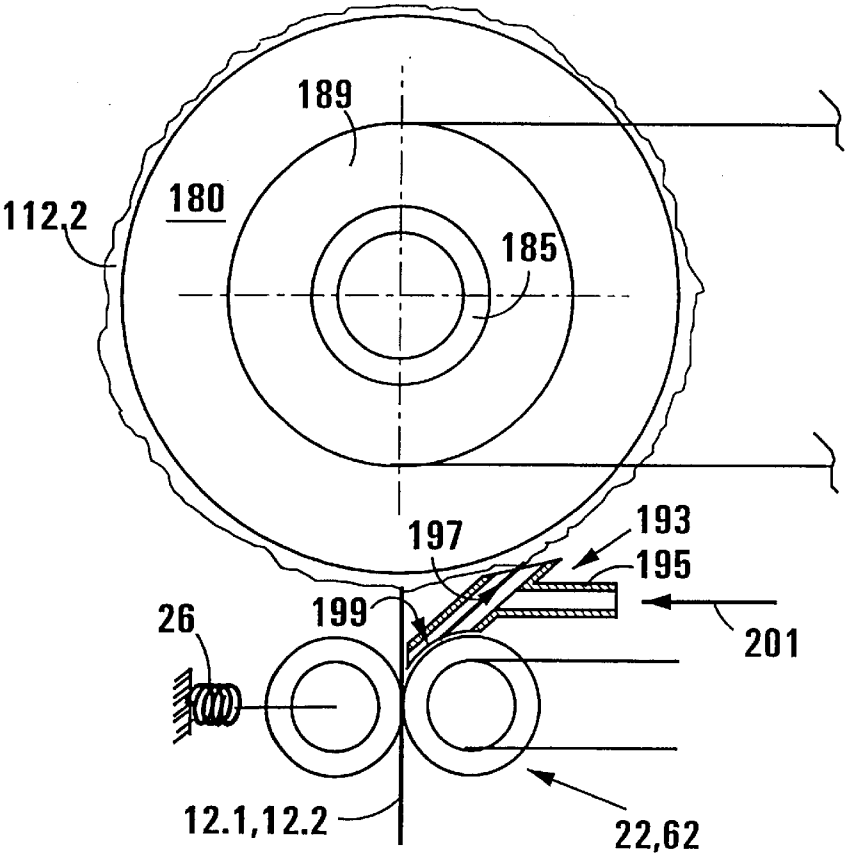

With reference to FIGS. 4 and 5, another device for gathering or collecting the fibres from the bundle 12.2 of loose or drafted fibres is shown. The device of Figures 4 and 5 will be immediately downstream of a location where the untwisted yarn or the bundle of loose or drafted fibres is desired to be collected, for example immediately downstream of or at the exit of the pair of nip rollers 22 or the pair of rollers 62.

The device of FIGS. 4 and 5 comprises a drum or wheel 180 rotatable about a transverse axis and having a periphery aligned with the path of the untwisted yarn or the bundle of loose or drafted fibres where it is to be collected. In this embodiment, the drum 180 is generally hollow and has a perforated or foraminous peripheral rim 181. It also has an axial sleeve or collar 183 by means of which it is removably received over a hollow spindle or journal 185 supported for rotation on bearings or bushes schematically as indicated by reference numeral 187. The hollow journal 185 is rotated via a pulley 189.

Suction (as shown at 191) is applied via the hollow journal 185 which is in communication with the hollow wheel 180 thus causing suction to be applied to the foraminous rim 181.

In use, as either untwisted yarn 12.1 exits directly from the nip rollers 22, or a bundle 12.2 of loose or drafted fibres exits from the rollers 62, the fibres are loosely collected in the form of a bundle 112.2 around the drum 180. After the deposition of a sufficient quantity of fibre, the deposited bundle 112.2 can be removed from the drum after removing the drum from the hollow journal. The bundle is removed in the form of a sliver of a certain length which corresponds to the circumference of the drum. Fibres in this configuration are suitable for certain textile tests.

Sometimes, better fibre separation results are obtained when the untwisted yarn is or loose and drafted fibres are steamed. This can be achieved by either removing the drum 180 from the hollow journal 185 and steaming the bundle 112.2 while it is still attached to the drum, or the untwisted yarn or loose or drafted fibres can be continuously steamed via a nozzle 193 provided for this purpose. The nozzle 193 comprises an inlet limb 195 which will be connected to a supply of steam under pressure as schematically shown at 201, and a tangential limb in the form of a chute. The untwisted yarn enters or the loose or drafted fibres enter the tangential limb via an inlet 199, is/are subjected to steam, and is/are guided via an exit 197 onto the drum. In this fashion, the untwisted yarn or loose or drafted fibres can be continuously steamed immediately prior to being wound onto the drum, and, in addition, the bundle of loose or drafted fibres wound onto the drum can be continuously steamed via the exit 197.

What is claimed is:

1. A method of obtaining fibres from a yarn for testing, including mechanically untwisting the yarn to a degree of 100%+30%, drafting said untwisted yarn to break remaining bonding between fibres which have formed the yarn, said drafting being at least partially between two pairs of nip rollers operating in series, a downstream pair of the nip rollers having a peripheral speed faster than a peripheral speed of an upstream pair of the nip rollers, mechanically separating said fibres, and gathering said fibres.

2. A method as claimed in claim 1 which includes unwinding the yarn from a reel, said untwisting the yarn being simultaneous with said unwinding of the yarn from the reel.

3. A method as claimed in claim 2 in which said untwisting the yarn is by rotating an arm about the reel and guiding the yarn through an eye at an end of the arm.

4. A method as claimed in claim 2 in which said untwisting the yarn is by rotating the reel about a polar axis of the reel while said unwinding is effected by spinning the reel about an unwinding axis of the reel.

5. A method as claimed in claim 2 in which said untwisting the yarn is at a rate of untwisting and in which said unwinding the yarn is at a rate of unwinding, said rate of untwisting being responsive to said rate of unwinding such that the rate of untwisting relative to the rate of unwinding is appropriate for a desired degree of untwisting.

6. A method as claimed in claim 1 in which drafting includes guiding the untwisted yarn between surfaces moving in the direction of drafting and pressing the fibres together to form a bundle of drafted fibres, the surfaces being provided by opposing surfaces of a pair of opposing, rotating, endless belts.

7. A method as claimed in claim 9 in which separating and gathering the fibres are by transporting them by means of air movement into a foraminous container.

8. A method as claimed in claim 7 in which said air movement is obtained by suction.

9. A method as claimed in claim 7 which includes loosely winding the fibres around a round drum provided for this purpose to gather the fibres.

10. A method as claimed in claim 9 in which the round drum is hollow and in which a periphery of the round drum is foraminous, the method including applying suction to suck the fibres onto the foraminous periphery.

11. A method as claimed in claim 9 which includes subjecting the fibres to steam and then removing the fibres from the round drum.

12. A yarn dismantling apparatus including mechanical untwisting means operable to untwist yarn formed of fibres; and separating means and gathering means for separating and gathering the fibres.

13. A yarn dismantling apparatus as claimed in claim 12 which includes a spindle for rotatably supporting a reel holding the yarn to be dismantled about an unwinding axis.

14. A yarn dismantling apparatus as claimed in claim 13 in which the mechanical untwisting means includes an arm having an eye at an end thereof, the arm being rotatable in a selected direction to cause the eye to orbit the reel in the selected direction, said apparatus including drive means for rotating the arm in said selected direction and at a selected speed by transmitting drive to the arm.

15. A yarn dismantling apparatus as claimed in claim 13 in which the untwisting means includes means for rotating the reel about a polar axis thereof.

16. A yarn dismantling apparatus as claimed in claim 13 which includes unwinding means for unwinding the yarn at a selected rate from the reel, the unwinding means including a pair of unwinding nip rollers downstream of the spindle, the unwinding nip rollers being rotatable such that a tangential speed thereof corresponds with a selected rate of unwinding.

17. A yarn dismantling apparatus as claimed in claim 16 which includes drafting means for drafting said untwisted yarn to break remaining bonding among respective fibres in which the drafting means includes a pair of driven drafting nip rollers downstream of the unwinding nip rollers, the apparatus including drive means drivingly connected to the drafting nip rollers to drive them at a tangential speed faster than that of the unwinding nip rollers, to cause corresponding drafting to an appropriate degree to break any remaining bonding among the fibres.

18. A yarn dismantling apparatus as claimed in claim 17 in which a spacing between the drafting nip rollers and any nip rollers upstream thereof is at least more than the longest fibre length in the yarn being dismantled.

19. A yarn dismantling apparatus as claimed in claim 17 in which, in at least one pair of the pairs of nip rollers, one roller is positively driven, the other roller is frictionally driven by said one roller, and said other roller is resiliently biassed toward said one, driven, roller.

20. A yarn dismantling apparatus as claimed in claim 17 in which the drafting means further includes opposing surfaces moving with the fibres being drafted to hold the fibres together in a bundle of drafted fibres, the opposing surfaces being provided by opposing surfaces of opposing rotating endless belts.

21. A yarn dismantling apparatus as claimed in claim 20 in which the separation means is in the form of suction means arranged for sucking fibres from the bundle of drafted fibres so as to separate the fibres.

22. A yarn dismantling apparatus as claimed in claim 21 which includes a foraminous collection container and guide means for guiding the separated fibres to the foraminous collection container.

23. A yarn dismantling apparatus as claimed in claim 21 which includes a round drum aligned with a path of the bundle of drafted fibres where the fibres are desired to be collected, and rotating means for rotating the drum to cause the untwisted yarn or the bundle of drafted fibres to be loosely wound over the drum, the suction means being arranged to suck the fibres onto a periphery of the drum, the drum being hollow and its periphery being foraminous to enable suction to be applied.

24. A yarn dismantling apparatus as claimed in claim 21 which includes steam means for steaming the bundle of drafted fibres.

25. A yarn dismantling apparatus as claimed in claim 24 in which the steam means includes a nozzle directed onto the bundle of drafted fibres, which nozzle is connected to a source of steam.

26. A yarn dismantling apparatus as claimed in claim 20 in which the separation means includes a rake member for raking the fibres from the bundle of drafted fibres so as to separate the fibres.

27. A yarn dismantling apparatus including a rotational support for rotatably supporting a reel holding yarn;

an unwinding device including a pair of unwinding nip rollers downstream of said rotational support, the unwinding nip rollers being rotatable such that a tangential speed thereof corresponds with a selective rate of unwinding the yarn from the reel;

an untwisting device for untwisting the yarn to a predetermined degree while the yarn is being unwound from the reel;

a drafting device downstream of the untwisting device, the drafting device including a pair of driven drafting nip rollers downstream of the unwinding nip rollers;

a drive drivingly connected to the drafting nip rollers to drive the drafting nip rollers at a tangential speed faster than that of the unwinding nip rollers to cause corresponding drafting to an appropriate degree to break any remaining bonding among the fibres.

28. A yarn dismantling apparatus as claimed in claim 27 in which a spacing between the drafting nip rollers and any nip rollers upstream thereof is at least more than the longest fibre length in the yarn being dismantled.

29. A yarn dismantling apparatus as claimed in claim 27 in which, in at least one pair of the pairs of nip rollers, one roller is positively driven, the other roller is frictionally driven by said one roller, and said other roller is resiliently biassed toward said one, driven, roller.

30. A yarn dismantling apparatus as claimed in claim 27 in which the drafting device further includes opposing surfaces movable with the fibres being drafted to hold the fibres together in a bundle of drafted fibres, the opposing surfaces being provided by opposing surfaces of opposing rotating endless belts.

31. A yarn dismantling apparatus as claimed in claim 30 which includes a separation device in the form of a suction device arranged for sucking fibres from the bundle of drafted fibres so as to separate the fibres.

32. A yarn dismantling apparatus as claim in claim 31 which includes a steaming device for steaming the bundle of drafted fibres.

33. A yarn dismantling apparatus as claim in claim 32 in which the steaming device includes a nozzle directed onto the bundle of drafted fibres, which nozzle is connected to a source of steam.

34. A yarn dismantling apparatus as claimed in claim 31 which includes a round drum aligned with a path of the bundle of drafted fibres where the fibres are desired to be collected, and rotating means for rotating the drum to cause the bundle of drafted fibres to be loosely wound over the drum, said suction device being arranged to suck the fibres onto a periphery of the drum, the drum being hollow and its periphery being foraminous to enable suction to be applied.

35. A yarn dismantling apparatus as claimed in claim 31 which includes a foraminous collection container and guide means for guiding the separated fibres to the foraminous collection container.

36. A yarn dismantling apparatus as claimed in claim 30 which includes a separation device including a rake member for raking the fibres from the bundle of drafted fibres so as to separate the fibres.

37. A yarn dismantling apparatus as claimed in claim 36 which includes a foraminous collection container and guide means for guiding the separated fibres to the foraminous collection container.

38. The yarn dismantling apparatus as claimed in claim 27 in which the rotational support is in the form of a spindle for supporting the reel rotationally, and in which the untwisting device includes an arm having an eye at an end thereof, the arm being rotatable in a selected direction to cause the eye to orbit the spindle in the selected direction, said yarn dismantling apparatus including a drive for rotating the arm in said selected direction and at a selected speed by transmitting drive to the arm.

39. A yarn dismantling apparatus as claimed in claim 27 in which said untwisting device includes a rotary support for holding the reel for rotation about a polar axis of said reel and a rotary drive for rotating said rotary support and said reel about said polar axis.

40. In a yarn dismantling apparatus for providing at a predetermined rate a yarn of fibres untwisted to a predetermined degree, the improvements comprising:

a first pair of nip rollers for receiving and passing therebetween the untwisted yarn, the first pair of nip rollers rotating at a first tangential speed; and a second pair of nip rollers receiving and passing therebetween the untwisted yarn passed by the first pair of nip rollers, the second pair of nip rollers rotating at a second tangential speed that is faster than the first tangential speed, whereby to break bonds among the fibres of the yarn.

* * * * *

UNITED STATES PATENT AND TRADEMARK OFFICE

CERTIFICATE OF CORRECTION

PATENT NO. : 6,205,758 B1
DATED : March 27, 2001
INVENTOR(S) : Etienne Weideman et al.

It is certified that error appears in the above-identified patent and that said Letters Patent is hereby corrected as shown below:

Title page,
Item [73], after "Corporation" insert -- (Proprietary) Limited --.

Signed and Sealed this

Fifth Day of February, 2002

*Attest:*

*Attesting Officer*

JAMES E. ROGAN
*Director of the United States Patent and Trademark Office*